US010300695B2

(12) United States Patent
Hiyoshi et al.

(10) Patent No.: US 10,300,695 B2
(45) Date of Patent: May 28, 2019

(54) INK JET PRINTER AND INK JET HEAD

(71) Applicant: TOSHIBA TEC KABUSHIKI KAISHA, Tokyo (JP)

(72) Inventors: Teruyuki Hiyoshi, Izunokuni Shizuoka (JP); Noboru Nitta, Kannami Shizuoka (JP); Syunichi Ono, Izu Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/682,911

(22) Filed: Aug. 22, 2017

(65) Prior Publication Data

US 2018/0079207 A1 Mar. 22, 2018

(30) Foreign Application Priority Data

Sep. 16, 2016 (JP) ..... 2016-181448

(51) Int. Cl.
*B41J 2/045* (2006.01)
*B41J 2/14* (2006.01)

(52) U.S. Cl.
CPC ..... *B41J 2/04586* (2013.01); *B41J 2/04521* (2013.01); *B41J 2/04541* (2013.01); *B41J 2/04581* (2013.01); *B41J 2/14* (2013.01); *B41J 2002/14362* (2013.01); *B41J 2002/14491* (2013.01); *B41J 2202/04* (2013.01); *B41J 2202/13* (2013.01)

(58) Field of Classification Search
CPC ..... B41J 2/04521; B41J 2/04541; B41J 2/04581; B41J 2/04586; B41J 2/14; B41J 2002/14362; B41J 2002/14491; B41J 2202/04; B41J 2202/13
See application file for complete search history.

(56) References Cited

U.S. PATENT DOCUMENTS

2013/0235104 A1* 9/2013 Ishii ..... B41J 2/04573 347/11
2015/0231907 A1* 8/2015 Otokita ..... B41J 29/393 347/10

FOREIGN PATENT DOCUMENTS

JP 2003-341063 12/2003
JP 2004-90262 3/2004

* cited by examiner

*Primary Examiner* — Lamson D Nguyen
(74) *Attorney, Agent, or Firm* — Kim & Stewart LLP

(57) ABSTRACT

An ink jet printer includes an ink jet head and an ink jet head control circuit supplying a control signal to control the ink jet head. The ink jet head includes a nozzle, an ink chamber, an actuator configured to change a pressure of the ink chamber to eject ink from the nozzle, a driver circuit that is connected to a signal line on which the control signal is supplied and configured to generate a drive waveform for driving the actuator according to the control signal, and a non-volatile memory connected to the signal line and configured to store information of the ink jet head. The ink jet head control circuit includes a drive control circuit connected to the signal line and configured to output the control signal to the signal line, and a non-volatile memory control circuit that accesses the non-volatile memory via the signal line.

16 Claims, 4 Drawing Sheets

INK JET PRINTER AND INK JET HEAD

CROSS-REFERENCE TO RELATED APPLICATION

This application is based upon and claims the benefit of priority from Japanese Patent Application No. 2016-181448, filed Sep. 16, 2016, the entire contents of which are incorporated herein by reference.

FIELD

Embodiments described herein relate generally to an ink jet printer and an ink jet head.

BACKGROUND

An ink jet printer prints patterns according to an input signal corresponding to an image or text. The ink jet printer includes, for example, an ink jet head and an ink jet head control circuit that controls the ink jet head. The ink jet head includes an actuator for ejecting ink and a driver integrated circuit (IC) that drives the actuator according to a control signal input from the ink jet head control circuit.

An ink jet head may include a non-volatile memory that stores unique information of the ink jet head, maintenance information, and the like. When a non-volatile memory is mounted on the ink jet head, the ink jet head control circuit also requires a connection terminal for accessing the non-volatile memory. However, adding such a terminal to the inkjet head control circuit and the inkjet head may increase costs.

DETAILED DESCRIPTION

In general, according to one embodiment, an ink jet printer includes an ink jet head and an ink jet head control circuit connected to the ink jet head and supplying a control signal to control the inkjet head. The inkjet head includes a nozzle, an ink chamber connected to the nozzle, an actuator configured to change a pressure of the ink chamber to eject ink from the nozzle, a driver circuit that is connected to a signal line on which the control signal from the ink jet head control circuit is supplied and configured to generate a drive waveform for driving the actuator according to the control signal, and a non-volatile memory connected to the signal line and configured to store information of the inkjet head. The inkjet head control circuit includes a drive control circuit connected to the signal line and configured to output the control signal to the signal line, and a non-volatile memory control circuit that accesses the non-volatile memory via the signal line connected to the non-volatile memory.

Figure 1:
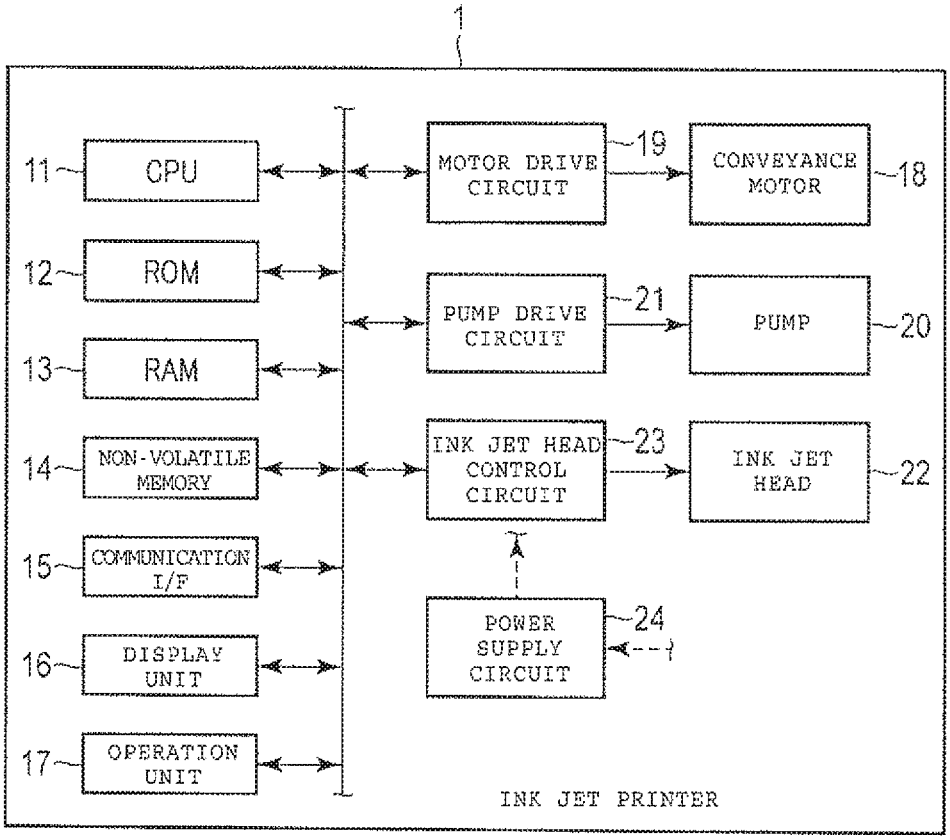
FIG. 1 is a diagram of an ink jet printer according to an embodiment.

Hereinafter, an ink jet printer and an ink jet head according to an example embodiment will be described with reference to the drawings. First, an ink jet printer will be described. FIG. 1 is a diagram of an ink jet printer 1.

The ink jet printer 1 is an example of an ink jet recording apparatus. The ink jet recording apparatus is not limited thereto and may be other apparatuses, such as a copying machine.

The ink jet printer 1 performs various processes such as image formation while conveying paper, which is a recording medium, for example. The inkjet printer 1 includes a CPU 11, a ROM 12, a RAM 13, a non-volatile memory 14, a communication interface (I/F) 15, a display unit 16, an operation unit 17, a conveyance motor 18, a motor drive circuit 19, a pump 20, a pump drive circuit 21, an ink jet head 22, an ink jet head control circuit 23, and a power supply circuit 24. Furthermore, the ink jet printer 1 may include a paper feed cassette and a paper discharge tray (not specifically depicted).

The CPU 11 is an arithmetic element, for example, a processor, that executes arithmetic processes. The CPU 11 performs various processes based on data, such as a program stored in the ROM 12. The CPU 11 functions as a control unit or controller capable of executing various operations by executing the program stored in the ROM 12. The CPU 11 inputs or supplies print data for forming an image on the recording paper to the ink jet head control circuit 23. The CPU 11 inputs or supplies a conveyance control signal for controlling conveyance of the recording paper to the motor drive circuit 19. The CPU 11 inputs or supplies an ink supply control signal for controlling supply of ink to the pump drive circuit 21.

The ROM 12 is a read-only non-volatile memory. The ROM 12 stores a program and data used by the program.

The RAM 13 is a volatile memory functioning as a working memory. The RAM 13 temporarily stores data or the like being processed or manipulated by the CPU 11. The RAM 13 temporarily stores programs being executed by the CPU 11.

The non-volatile memory 14 is a storage medium that can store various information. The non-volatile memory 14 stores a program and data that may be used in the program. The non-volatile memory 14 is, for example, a solid-state drive (SSD), a hard disk drive (HDD), or other storage devices. Instead of a non-volatile memory 14, a memory interface (I/F) such as a card slot into which a storage medium, such as a memory card, can be inserted may be provided.

The communication I/F 15 is an interface for communicating with other devices. The communication I/F 15 is used for communication with, for example, a host device that transmits print data to the ink jet printer 1. The communication I/F 15 may perform wireless communication with other devices according to standards such as Bluetooth® or Wi-fi®).

The display unit 16 is a display device which displays a screen according to a video signal from the CPU 11 or a display control unit, such as a graphic controller, (not specifically depicted). For example, on the display unit 16, a screen for setting parameters or otherwise controlling the ink jet printer 1 can be displayed.

The operation controller 17 generates an input signal based on a user's operation of an input device, or the like. The input device connected to the operation controller 17 is, for example, a touch sensor, a ten key keypad, a power button, a paper feed key, various function keys, a keyboard, or the like. The touch sensor is, for example, a resistive touch sensor or a capacitive touch sensor. The touch sensor acquires information indicating a user designated position within a certain area. The touch sensor can be configured as a touch panel integrated with the above-described display unit 16 to input a signal indicating a touched position on a screen displayed on the display unit 16 to the CPU 11.

The conveyance motor 18 operates a conveyor device of a conveyance path (not specifically depicted) for conveying the paper by rotating the conveyor device. The conveyor device comprises, for example, a belt, a roller, a guide track, and the like which operate to convey the paper for a printing process. For example, the conveyance motor 18 conveys the paper along a guide track by driving a roller operating in conjunction with a belt that holds the paper.

The motor drive circuit 19 drives the conveyance motor 18. The motor drive circuit 19 drives the conveyance motor 18 in accordance with the conveyance control signal input from the CPU 11 to convey the paper from the paper feed cassette to the paper discharge tray while passing the inkjet head 22. The paper feed cassette is a cassette that accommodates a plurality of sheets of paper. The paper discharge tray accommodates the paper on which an image has been formed and that has been discharged by the ink jet printer 1.

The pump 20 includes a tube that communicates the ink jet head 22 with, for example, an ink tank (not specifically depicted) in which ink is held. Specifically, the tube communicates with a common liquid chamber (not specifically depicted) of the ink jet head 22.

The pump drive circuit 21 supplies ink from the ink tank to the common liquid chamber of the inkjet head 22 by driving the pump 20 according to the ink supply control signal from the CPU 11.

The ink jet head 22 is an image forming unit, such as a printer unit, that forms an image on the paper. The inkjet head 22 forms an image on the paper by ejecting ink onto the paper held by a holding roller (not specifically depicted). The ink jet printer 1 may include a plurality of the ink jet heads 22 corresponding to different colors such as cyan, magenta, yellow, and black, for example.

The ink jet head control circuit 23 drives the ink jet head 22. The ink jet head control circuit 23 causes ink to be ejected from the ink jet head 22 by driving the ink jet head 22. The ink jet head control circuit 23 drives the ink jet head 22, in accordance with the print data from the CPU 11, to form an image, in accordance with the print data, on the paper.

The power supply circuit 24 converts AC power supplied from a commercial power supply (not specifically depicted) to DC power and supplies the DC power to components in the ink jet printer 1.

Figure 2:
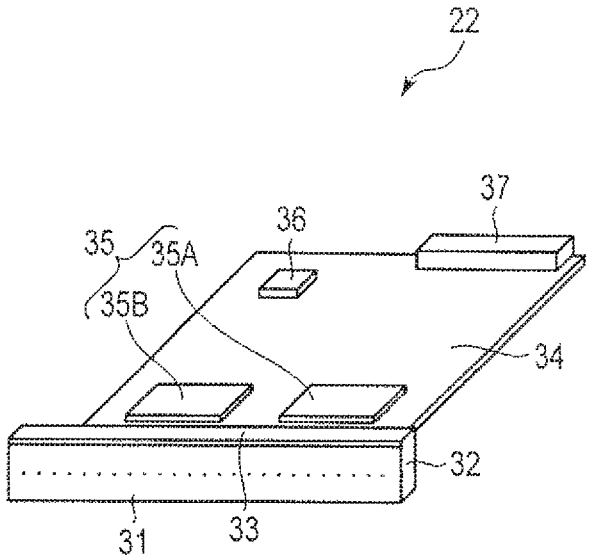
FIG. 2 is a diagram of an ink jet head according to an embodiment.

FIG. 2 shows an ink jet head 22. The ink jet head 22 includes a discharge nozzle 31, an ink liquid chamber 32, an actuator 33, a head substrate 34, a driver integrated circuit (IC) 35, a non-volatile memory 36, and an interface (I/F) connector 37.

The discharge nozzle 31 is a hole through which ink is ejected.

The ink liquid chamber 32 is a space that can be filled with ink. The ink liquid chamber 32 includes a common liquid chamber (not specifically depicted) and a pressure chamber partitioned by an actuator 33 for each discharge nozzle 31. The common liquid chamber can be filled with ink supplied from the ink tank. The pressure chamber is a chamber whose pressure can be controlled by the actuator 33.

The actuator 33 is a piezoelectric element that causes a pressure change in the pressure chamber of the ink liquid chamber 32 by deforming according to an applied voltage input. The actuator 33 is driven by the voltage from the driver IC 35. When the actuator 33 is driven to lower the pressure inside the pressure chamber, ink is drawn from the common liquid chamber of the ink liquid chamber 32 into the pressure chamber of the ink liquid chamber 32. When the actuator 33 is driven to increase the pressure inside the pressure chamber of the ink liquid chamber 32, the ink in the pressure chamber of the ink liquid chamber 32 is ejected through the discharge nozzle 31.

The head substrate 34 is a substrate on which the discharge nozzle 31, the ink liquid chamber 32, the actuator 33, the driver IC 35, the non-volatile memory 36, and the I/F connector 37 are mounted. The head substrate 34 can be configured as a glass-epoxy substrate or a flexible substrate using a polyimide film as a base material.

The ink jet head control circuit 23 controls the driver IC 35 to drive the actuator 33 by applying a voltage with respect to an electrode (not specifically depicted) of the actuator 33. For example, the driver IC 35 generates a drive waveform DOUT (for driving each actuator 33 according to image data input from the ink jet head control circuit 23 and outputs the generated drive waveforms DOUT to the actuators 33. Specifically, the driver IC 35 includes a register that temporarily stores the image data input from the ink jet head control circuit 23. The driver IC 35 sets drive conditions including a period and shape of the drive waveform DOUT according to the register setting data input from the ink jet head control circuit 23. The driver IC 35 sets a number of repetitive drive waveforms DOUT based on the image data stored in the register. In this way, the driver IC 35 generates the above-described drive waveform DOUT based on the image data and the drive conditions. In the present example, the driver IC 35 includes two pieces, the driver IC 35A and the driver IC 35B, having the same configuration that are mounted on the head substrate 34.

The non-volatile memory 36 stores various information of the ink jet head 22. The non-volatile memory 36 is a one-wire non-volatile memory in which data can be stored and read via the same signal line. The non-volatile memory 36 stores, for example, unique information of the ink jet head 22, maintenance information, and the like. The unique information is, for example, the serial number of the ink jet head 22, a recommended voltage, an Acoustic Length (AL) rank, and the like. The AL rank indicates a characteristic vibration period of the ink in the ink liquid chamber 32 and is used for selecting a drive waveform. The maintenance information indicates a usage history of the ink jet head 22 such as date and time of a first use of the ink jet head 22, date and time of a last use, a number of lines that have been cumulatively printed, and an operating temperature, for example.

The I/F connector 37 is an interface for connecting the ink jet head control circuit 23 and the ink jet head 22.

Figure 3:
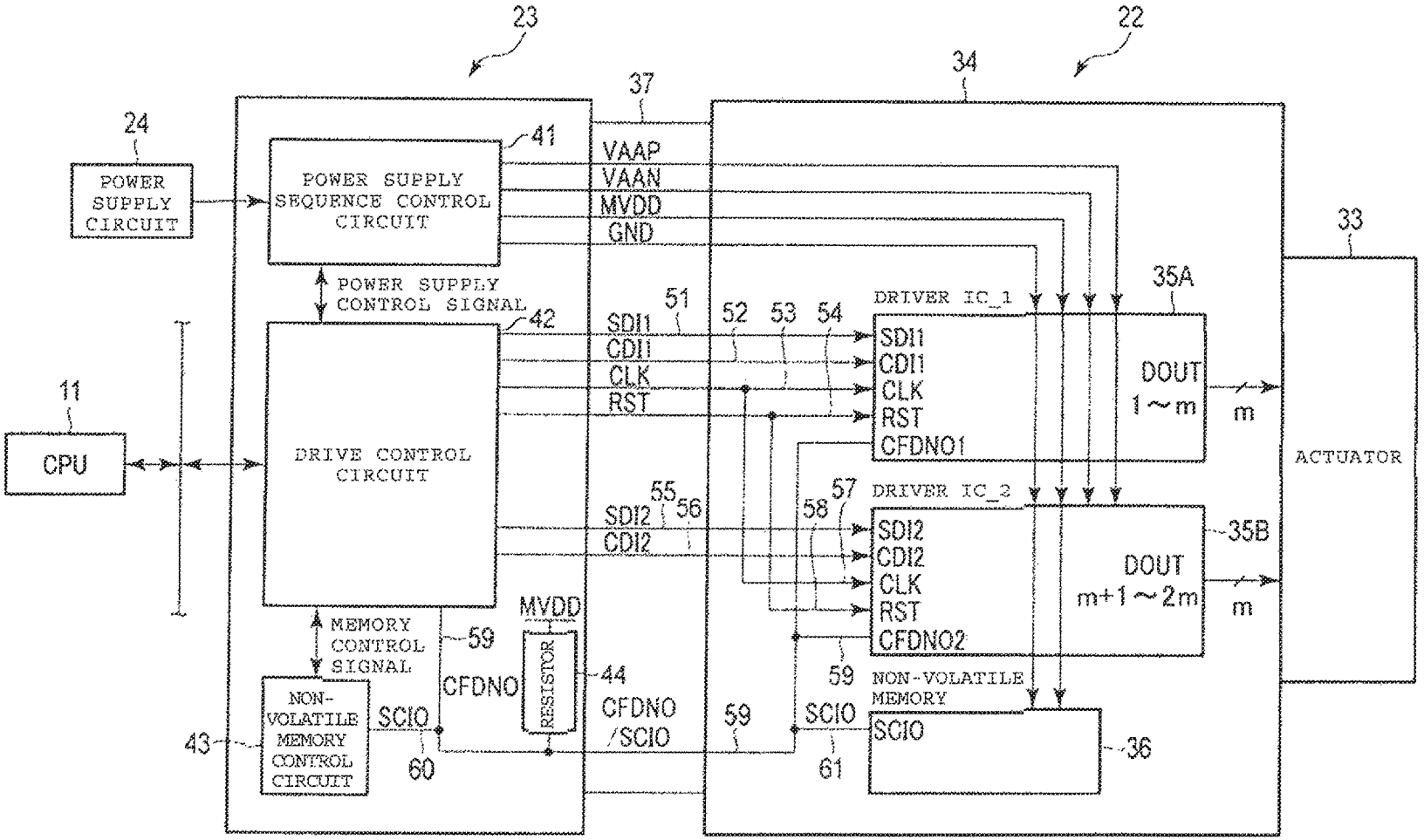
FIG. 3 is a diagram of an ink jet head and an ink jet head control circuit according to an embodiment.

FIG. 3 shows an ink jet head 22 and an ink jet head control circuit 23. The ink jet head 22 and the ink jet head control circuit 23 are connected via the I/F connector 37.

The ink jet head control circuit 23 sets the drive conditions in the driver ICs 35A and 35B of the ink jet head 22 by transmitting register setting data to the ink jet head 22.

The ink jet head control circuit 23 converts a timing signal output from an encoder of the conveyance motor 18 into a line position and controls a timing of transmitting the image data to the ink jet head 22.

The ink jet head control circuit 23 includes a power supply sequence control circuit 41, a drive control circuit 42, a non-volatile memory control circuit 43, and a resistor 44.

The power supply sequence control circuit 41 supplies various power supply voltages used in the inkjet head 22 with respect to the inkjet head 22. For example, the power supply sequence control circuit 41 converts the power supplied from the power supply circuit 24 to a voltage requested at a supply destination and supplies the voltage. For example, the power supply sequence control circuit 41 generates a logic power supply MVDD and the drive power supply voltages VAAP and VAAN by using the power supplied from the power supply circuit 24.

The logic power supply MVDD is 5 V, for example. The logic power supply MVDD is used to power supply of the logic circuit in the driver ICs 35A and 35B of the ink jet head 22 and to drive switching elements.

The drive power supply VAAP is a variable voltage that varies between 7 and 18 V, for example. The drive power supply VAAN is a variable voltage that varies between −7 and −18 V, for example. The drive power supplies VAAP and VAAN are used to generate the drive waveform DOUT for driving the actuator 33.

The power supply sequence control circuit 41 supplies the voltage of the logic power supply MVDD to the driver IC 35A, the driver IC 35B, and the non-volatile memory 36 via the I/F connector 37. In addition, a GND line is connected between the power supply sequence control circuit 41, the driver IC 35A, the driver IC 35B, and the non-volatile memory 36.

The power supply sequence control circuit 41 supplies the voltages of the drive power supply voltages VAAP and VAAN to the driver ICs 35A and 35B via the I/F connector 37. At this time, the power supply sequence control circuit 41 controls respective voltage values and on/off timings of the drive power supply voltages VAAP and VAAN.

As shown in FIG. 3, the ink jet head 22 and the ink jet head control circuit 23 are connected via the I/F connector 37. The power supply sequence control circuit 41 supplies the logic power supply MVDD, the drive power supply VAAP, and the drive power supply VAAN to the driver IC 35A and the driver IC 35B via lines therebetween. As shown in FIG. 3, the ink jet head 22 and the ink jet head control circuit 23 are connected via the I/F connector 37, whereby the power supply sequence control circuit 41 further supplies the logic power supply MVDD to the non-volatile memory 36 via a line therebetween.

Under the control of the CPU 11, the drive control circuit 42 controls respective voltage values and on/off timings of the drive power supplies VAAP and VAAN of the power supply sequence control circuit 41. The drive control circuit 42 supplies various signals used to drive the actuator 33 in the ink jet head 22. For example, the drive control circuit 42 generates image data SDI1 and SDI2, register setting data CDI1 and CDI2, a clock signal CLK, and a reset signal RST according to the print data supplied from the CPU 11.

The image data SDI1 is a signal for serially transferring the image data used for driving the switching elements of the driver IC 35A. The image data SDI2 is a signal for serially transferring the image data used for driving the switching elements of the driver IC 35B.

The register setting data CDI1 is a signal for serially transferring the register setting data used for the register setting for setting of the drive conditions in the driver IC 35A. The register setting data CDI2 is a signal for serially transferring the register setting data used for the register setting for setting of the drive conditions in the driver IC 35B.

The clock signal CLK is a reference clock signal of the logic circuit portion of the driver IC 35A and the driver IC 35B.

The reset signal RST is a signal for resetting the hardware of the driver IC 35A and the driver IC 35B.

The drive control circuit 42 supplies the image data SDI1 to the driver IC 35A via the I/F connector 37. The drive control circuit 42 supplies the image data SDI2 to the driver IC 35B via the I/F connector 37.

The drive control circuit 42 supplies the register setting data CDI1 to the driver IC 35A via the I/F connector 37. The drive control circuit 42 supplies the register setting data CDI2 to the driver IC 35B via the I/F connector 37.

The drive control circuit 42 supplies the clock signal CLK to the driver IC 35A and the driver IC 35B via the I/F connector 37.

The drive control circuit 42 supplies the reset signal RST to the driver IC 35A and the driver IC 35B via the I/F connector 37. When the reset signal RST is input to the driver IC 35A and the driver IC 35B, the register data is reset. As a result, the image data and the register setting data stored in the register are deleted.

The drive control circuit 42 inputs a control signal for causing the non-volatile memory control circuit 43 to control the non-volatile memory 36 under the control of the CPU 11 to the non-volatile memory control circuit 43.

As shown in FIG. 3, the ink jet head 22 and the ink jet head control circuit 23 are connected via the I/F connector 37. Via the I/F connector 37, the drive control circuit 42 and the driver IC 35A have a signal line 51 for transmitting the image data SDI1 therebetween. Via the I/F connector 37, the drive control circuit 42 and the driver IC 35A have a signal line 52 for transmitting the register setting data CDI1 therebetween. Via the I/F connector 37, the drive control circuit 42 and the driver IC 35A have a signal line 53 for transmitting the clock signal CLK therebetween. In addition, via the I/F connector 37, the drive control circuit 42 and the driver IC 35A have a signal line 54 for transmitting the reset signal RST therebetween.

Via the I/F connector 37, the drive control circuit 42 and the driver IC 35B have a signal line 55 for transmitting the image data SDI2 therebetween. Via the I/F connector 37, the drive control circuit 42 and the driver IC 35B have a signal line 56 for transmitting the register setting data CDI2 therebetween. In addition, via the I/F connector 37, the drive control circuit 42 and the driver IC 35B have a signal line 57 for transmitting the clock signal CLK therebetween. The signal line 57 may be configured by branching from the above-described signal line 53. Via the I/F connector 37, the drive control circuit 42 and the driver IC 35B have a signal line 58 for transmitting the reset signal RST therebetween. The signal line 58 may be configured by branching from the above-described signal line 54.

Via the I/F connector 37, the drive control circuit 42 and the driver IC 35A and the driver IC 35B have a signal line 59 for transmitting a setting completion signal CFDNO (to be described later) therebetween. An output terminal for outputting the setting completion signal CFDNO of the driver IC 35A and the driver IC 35B is connected to a signal line 59.

The non-volatile memory control circuit 43 reads the information stored in the non-volatile memory 36 of the ink jet head 22 or transmits a command for writing information to the non-volatile memory 36 according to the instruction of the drive control circuit 42. Specifically, the non-volatile memory control circuit 43 causes the non-volatile memory 36 to read or write information by transmitting a control signal SCIO for controlling the non-volatile memory 36 to the non-volatile memory 36.

In the non-volatile memory control circuit 43, a terminal that outputs the control signal SCIO is connected to the above-described signal line 59 by a signal line 60.

The resistor 44 is connected between the signal line 59 and the logic power supply MVDD in the ink jet head control circuit 23. The resistor 44 is a pull-up resistor that raises the voltage of the signal line 59 to a voltage in accordance with the logic power supply MVDD.

In the non-volatile memory 36 of the ink jet head 22, a terminal to which the control signal SCIO is input is connected to the above-described signal line 59 by a signal line 61.

Operation of the ink jet head 22 and the ink jet head control circuit 23 will be described.

Figure 4:
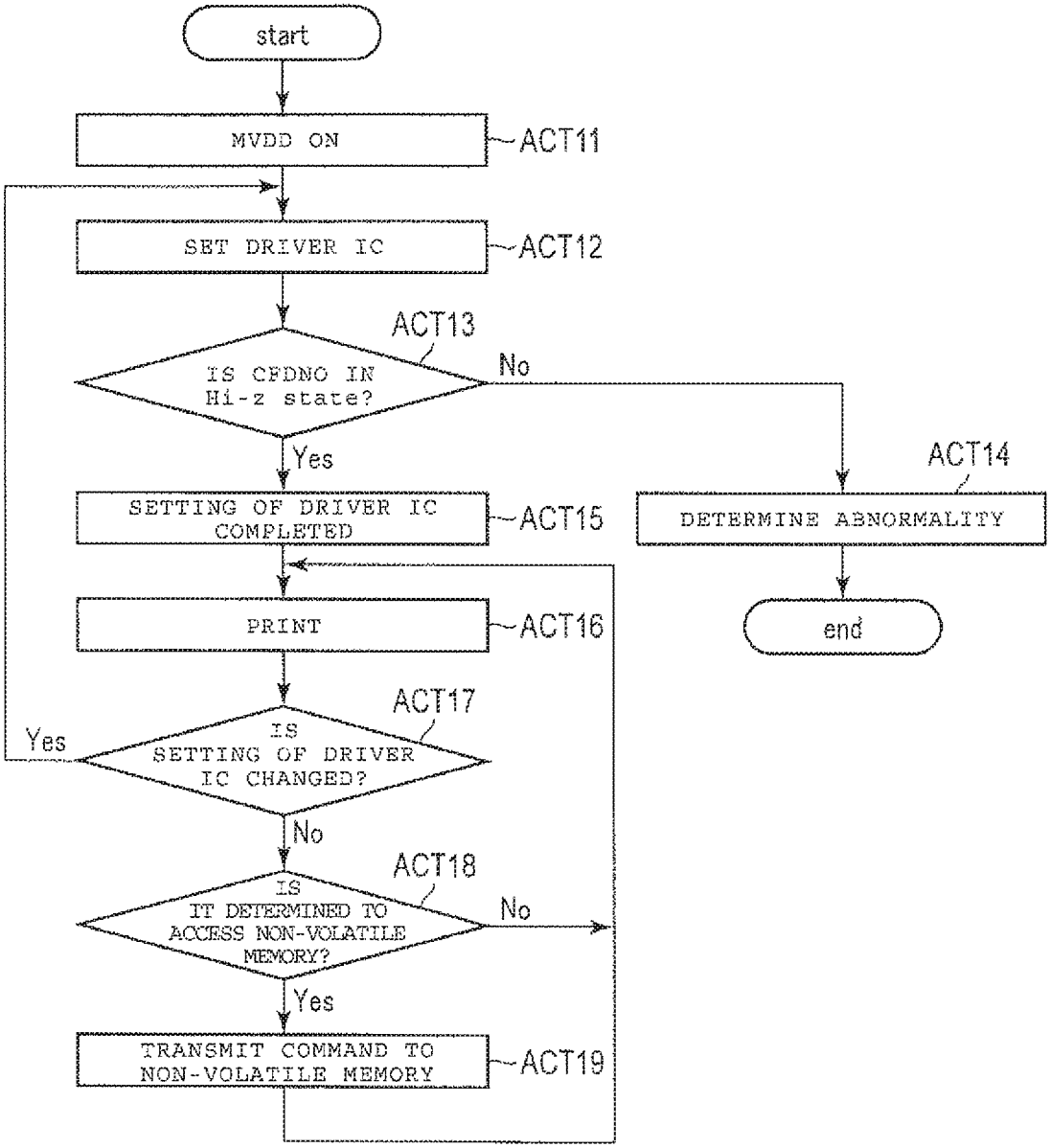
FIG. 4 is a diagram of an operation of an ink jet head control circuit according to an embodiment.
Figure 5:
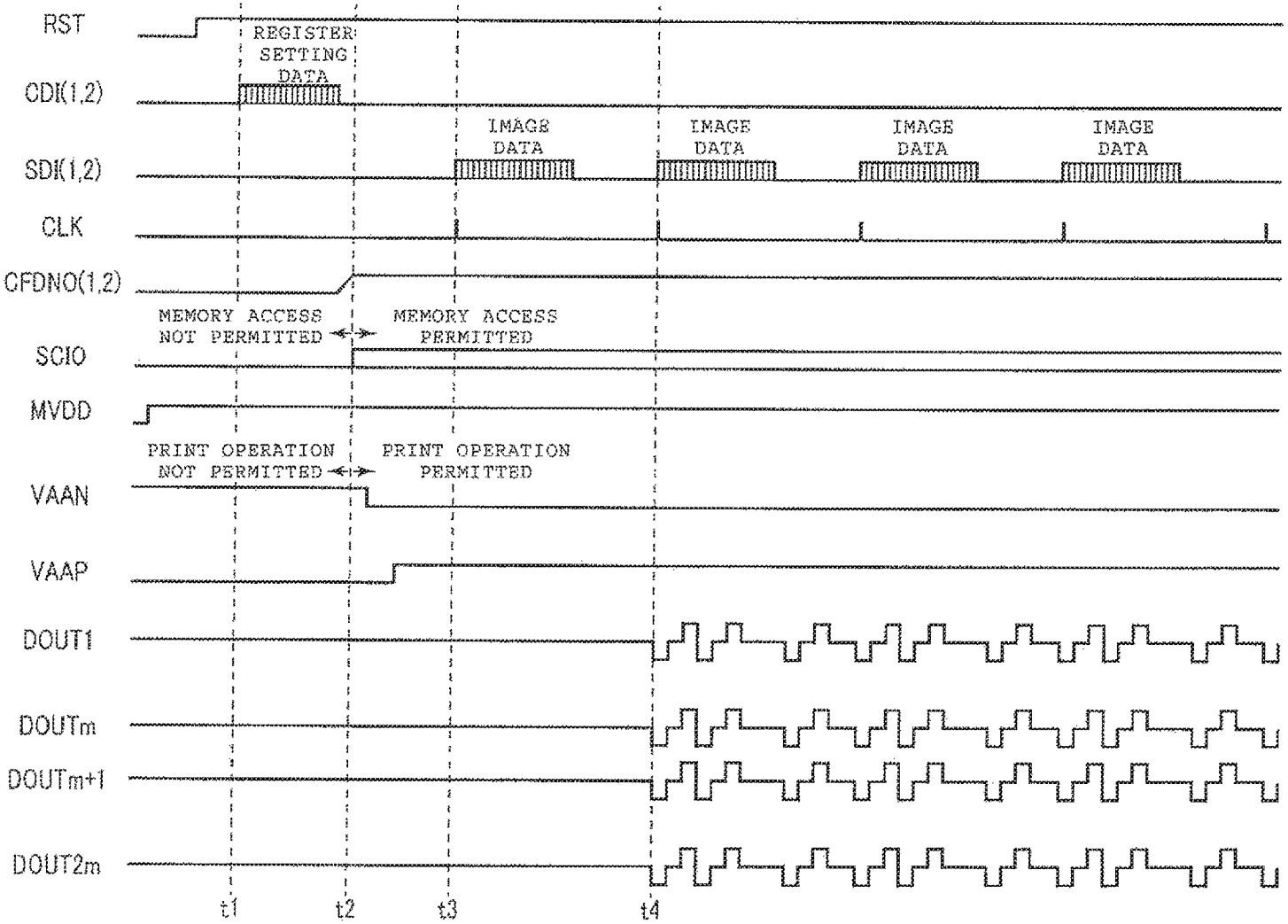
FIG. 5 is a diagram an operation of an ink jet head control circuit and an ink jet head according to the embodiment.

FIGS. 4 and 5 are explanatory diagrams for explaining the operations of the ink jet head 22 and the ink jet head control circuit 23.

When controlling the ink jet head 22, the drive control circuit 42 of the ink jet head control circuit 23 first turns on the logic power supply MVDD (ACT 11). For example, the drive control circuit 42 may turn on the logic power supply MVDD and transmit the reset signal RST as shown in FIG. 5.

The drive control circuit 42 first transmits the register setting data CDI with respect to the driver IC 35 of the ink jet head 22 (ACT 12). Specifically, at a timing t1 shown in FIG. 5, the drive control circuit 42 transmits the register setting data CDI1 by the signal line 52 with respect to the driver IC 35A of the ink jet head 22. At the timing t1 shown in FIG. 5, the drive control circuit 42 transmits the register setting data CDI2 by the signal line 57 with respect to the driver IC 35B of the ink jet head 22.

When the driver IC 35A and the driver IC 35B, which are also collectively referred to as a driver IC 35, of the ink jet head 22 receive the register setting data CDI from the drive control circuit 42, the driver IC 35A and the driver IC 35B set the drive conditions, for example, a waveform shape of the drive waveform DOUT, according to the received register setting data CDI. Specifically, the driver IC 35 analyzes the value of the register setting data, and if the value is normal, completes the setting of the drive conditions by storing the register setting data in the register. When the setting of the drive conditions is completed, the driver IC 35 sets a terminal that outputs the setting completion signal CFDNO, which is the terminal to which the signal line 59 is connected, in a high impedance (Hi-Z) state.

For example, the driver IC 35 includes a control switch (not specifically depicted) that controls the conduction state between the terminal outputting the setting completion signal CFDNO and GND. The control switch may be an open drain type FET that electrically connects the signal line 59 and GND when the control switch is turned on, for example, and releases the signal line 59 and GND when the control switch is turned off.

Specifically, the driver IC 35 sets the voltage of the signal line 59 to GND by turning on the control switch when the setting of the drive conditions is not completed. That is, the driver IC 35 sets the voltage of the signal line 59 to a low level when the setting of the drive conditions is not completed. When at least one of the driver IC 35A and the driver IC 35B turns on the control switch, the voltage of the signal line 59 is lowered to a low level.

When the setting of the drive conditions is completed, the driver IC 35 releases the signal line 59 by turning off the control switch and setting the terminal that outputs the setting completion signal CFDNO in a high impedance state. When the control switches of both the driver IC 35A and the driver IC 35B are turned off, the signal line 59 is released from the driver IC 35A and the driver IC 35B.

The signal line 59 released from the driver IC 35A and the driver IC 35B is raised to the voltage in accordance with the logic power supply MVDD by the resistor 44. For example, at a timing t2 shown in FIG. 5, when the setting of the drive conditions is completed and the signal line 59 is released from the driver IC 35A and the driver IC 35B, the voltage of the signal line 59 is raised from a low level to a voltage in accordance with the logic power supply MVDD. Thus, memory access to the non-volatile memory 36 by the non-volatile memory control circuit 43 is permitted.

The drive control circuit 42 determines whether or not setting of the drive conditions in the driver IC 35A and the driver IC 35B is completed by detecting the voltage of the signal line 59. Specifically, the drive control circuit 42 determines whether or not a terminal that outputs the setting completion signal CFDNO of the driver IC 35A and the driver IC 35B is in a Hi-z state (ACT 13). When the voltage of the signal line 59 is raised (the voltage of the signal line 59 is at the voltage in accordance with the logic power supply MVDD), the drive control circuit 42 determines that the terminal that outputs the setting completion signal CFDNO of the driver IC 35A and the driver IC 35B in the Hi-z state. When the drive control circuit 42 determines that the terminal that outputs the setting completion signal CFDNO of the driver IC 35A and the driver IC 35B is in the Hi-z state, the drive control circuit 42 determines that setting of the drive conditions in the driver IC 35A and the driver IC 35B is completed.

For example, when the terminal that outputs the setting completion signal CFDNO is not in the Hi-z state within a predetermined time after transmitting the register setting data CDI to the driver IC 35 (ACT 13, NO), the drive control circuit 42 determines that the setting of the drive conditions is not performed normally in the driver IC 35 (ACT 14) and ends the process.

When the drive control circuit 42 determines that the terminal that outputs the setting completion signal CFDNO is in the Hi-z state (ACT 13, YES), the drive control circuit 42 determines that setting of the drive conditions in the driver IC 35 is completed (ACT 15).

When determining that setting of the drive conditions in the driver IC 35 is completed, the drive control circuit 42 causes the inkjet head 22 to print by transmitting the image data SDI to the driver IC 35 (ACT 16). For example, as shown in FIG. 5, the drive control circuit 42 transmits the image data SDI from a timing t3 at a constant cycle in accordance with a synchronization signal CLK. For example, the image data SDI is transmitted by serial communication for each line. In the ink jet head 22, the driver IC 35 stores the image data SDI received from the drive control circuit 42 respectively in the register. The driver IC 35 of the ink jet head 22 generates the drive waveform DOUT based on the image data and the drive conditions stored in the register and starts outputting the drive waveform DOUT at a timing t4 in FIG. 5. Still further, the drive control circuit 42 starts the supply of the drive power supply VAAN and the drive power supply VAAP to the driver IC 35.

The drive control circuit 42 determines whether or not to change the drive conditions of the driver IC 35 (ACT 17). When an instruction for changing the drive conditions of the driver IC 35 is input from the CPU 11, the drive control circuit 42 determines to change the drive conditions of the driver IC 35. When the drive control circuit 42 determines to change the drive conditions of the driver IC 35 (ACT 17, YES), the drive control circuit 42 proceeds to the process of ACT 12.

When the drive control circuit 42 determines not to change the drive conditions of the driver IC 35 (ACT 17, NO), the drive control circuit 42 determines whether or not to access the non-volatile memory 36 of the ink jet head 22 (ACT 18). When an instruction for accessing the non-volatile memory 36 is input from the CPU 11, the drive control circuit 42 determines to access the non-volatile memory 36. When drive control circuit 42 determines not to access the non-volatile memory 36 (ACT 18, NO), the drive control circuit 42 proceeds to the process of ACT 16 and continues printing.

When the drive control circuit 42 determines to access the non-volatile memory 36 (ACT 18, YES), the drive control circuit 42 inputs a memory control signal for causing the non-volatile memory control circuit 43 to generate a command in accordance with an instruction from the CPU 11 and to transmit the generated command to the non-volatile memory 36 to the non-volatile memory control circuit 43.

The non-volatile memory control circuit 43 generates a command in accordance with the memory control signal, transmits the command to the non-volatile memory 36 by using the signal line 59 released from the driver IC 35A and the driver IC 35B (ACT 19), and proceeds to the process of ACT 16. For example, the non-volatile memory control circuit 43 transmits a command to the non-volatile memory 36 by controlling the voltage of the signal line 59 to a low level and a high level according to the generated command.

The non-volatile memory 36 of the ink jet head 22 is configured to detect the voltage of the signal line 59 via the signal line 61. In addition, the non-volatile memory 36 includes a switch that switches the voltage of the signal line 59 between a low level and a high level via the signal line 60.

The non-volatile memory 36 acquires the command transmitted from the non-volatile memory control circuit 43 by detecting the voltage of the signal line 59. The non-volatile memory 36 executes a process in accordance with the acquired command to generate a response indicating the result of the process. The non-volatile memory 36 transmits a response to the non-volatile memory control circuit 43 by controlling the voltage of the signal line 59 to a low level and a high level according to the generated response.

The non-volatile memory control circuit 43 acquires the response transmitted from the non-volatile memory control circuit 36 by detecting the voltage of the signal line 59.

As described above, the ink jet head 22 is connected to the driver IC 35 and a one-wire type non-volatile memory 36 and is also connected to the ink jet head control circuit 23 by the signal line 59 released from the driver IC 35 at a certain timing. When the ink jet head control circuit 23 recognizes that the driver IC 35 of the ink jet head 22 has released the signal line 59, the ink jet head control circuit 23 accesses the non-volatile memory 36 using the signal line 59. Thus, the ink jet printer 1 can share one signal line for communicating with the driver IC 35 and communicating with the non-volatile memory 36. That is, the ink jet printer 1 can use the ink jet head 22, having the non-volatile memory 36 added, without adding signal lines. Thus, the ink jet printer and the ink jet head with added features can be provided at a low cost.

The signal line 59, described above, is connected to a terminal used for setting the drive conditions of the driver IC 35 and the one-wire type non-volatile memory 36. The driver IC 35 releases the signal line 59 when the setting of the drive conditions has been completed. Usually, the drive conditions are not set unless the drive conditions have been changed after a start of printing. In this way, the ink jet printer 1 can secure the signal line 59 for the non-volatile memory 36 to access for a majority of time after the drive conditions of the driver IC 35 are initially set. That is, the ink jet printer 1 may be continuously accessible to the non-volatile memory 36 after the setting of the drive conditions of the driver IC 35 has been completed.

The terminal used for setting the drive conditions of the driver IC 35 is connected to an open drain type FET which is switched from the GND connection state to the released state when setting the drive conditions is completed. The signal line 59 is connected to the resistor 44 which raises a voltage by a power supply (the logic power supply MVDD), when the signal line 59 is released from the driver IC 35. Thus, the signal line 59 is maintained at a predetermined voltage when the signal line 59 is released from the driver IC 35. In such a configuration, the non-volatile memory control circuit 43 and the non-volatile memory 36 can communicate data by controlling the voltage of the signal line 59 to a low level and a high level.

In the above-described example embodiment, the drive control circuit 42 performs a determination in ACT 13, ACT 17, and ACT 18 in FIG. 4. However, the present embodiment is not limited to this configuration. The determination may be executed by the CPU 11.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet printer, comprising:

an ink jet head; and an ink jet head control circuit connected to the ink jet head and supplying a control signal to control the ink jet head, wherein the ink jet head includes:

a nozzle;

an ink chamber connected to the nozzle;

an actuator configured to change a pressure of the ink chamber to eject ink from the nozzle;

a driver circuit that is connected to a signal line on which the control signal from the ink jet head control circuit is supplied, and configured to generate a drive waveform for driving the actuator according to the control signal;

a non-volatile memory connected to the signal line and configured to store information of the ink jet head;

a substrate on which the driver circuit and the non-volatile memory are disposed; and a connector on the substrate, the connector being electrically connected to the ink jet head control circuit, wherein the signal line connects to each of the driver circuit and the non-volatile memory via a connection in the connector; and the ink jet head control circuit includes:

a drive control circuit connected to the signal line and configured to output the control signal to the signal line; and a non-volatile memory control circuit that accesses the non-volatile memory via the signal line connected to the non-volatile memory.

2. The ink jet printer according to claim 1, further comprising:

a control switch that electrically connects the signal line to a ground potential when the driver circuit supplies the drive waveform to the actuator via the signal line.

3. The ink jet printer according to claim 2, wherein the control switch electrically disconnects the signal line from the ground potential when the ink jet head control circuit accesses the non-volatile memory via the signal line.

4. The ink jet printer according to claim 3, wherein the ink jet head control circuit supplies register setting data to the non-volatile memory the driver circuit outputs the drive waveform according to the register setting data supplied from the non-volatile memory, and the control switch electrically disconnects the signal line from the ground potential after the drive waveform has been output.

5. The ink jet printer according to claim 4, wherein the register setting data for determining the drive waveform specifies a period and a shape of the drive waveform.

6. The ink jet printer according to claim 1, further comprising:

a power supply sequence control circuit connected to the drive circuit via an interface connector, wherein the power supply sequence control circuit supplies a logic power supply voltage and a drive power supply voltage to the drive circuit.

7. The ink jet printer according to claim 6, wherein the power supply sequence control circuit further supplies the logic power supply voltage to the non-volatile memory.

8. An ink jet head, comprising:

a nozzle in fluid communication with an ink chamber;

an actuator configured to change a volume of the ink chamber to eject ink via the nozzle;

a connector at which a signal line from an ink jet head control circuit can be connected to supply a control signal and register setting data;

a driver circuit connected to the signal line and configured to generate a drive waveform for driving the actuator according to the control signal and the register setting data; and a non-volatile memory connected to the signal line and configured to store register setting data supplied via the signal line from the ink jet head control circuit.

9. The ink jet head according to claim 8, wherein the drive circuit is supplied with a logic power supply voltage and a drive power supply voltage via the connector, and the non-volatile memory is supplied with the logic power supply voltage via the connector.

10. The ink jet head according to claim 8, wherein the register setting data is supplied from the non-volatile memory to the driver circuit.

11. The ink jet head according to claim 8, further comprising:

a substrate on which the connector, the driver circuit, and the non-volatile memory are disposed.

12. The ink jet head according to claim 8, wherein the register setting data specifies a period and a shape of the drive waveform.

13. An ink jet head control circuit, comprising:

a drive control circuit configured to output a control signal to a driver circuit of an ink jet head via a signal line;

a non-volatile memory control circuit that controls access to a non-volatile memory of the ink jet head via the signal line; and a control switch that electrically connects the signal line to a ground potential when the control signal is supplied to the driver circuit of the ink jet head via the signal line, wherein data is supplied to the non-volatile memory of the ink jet head via the signal line, and the data specifies a period and a shape of a drive waveform generated in the ink jet head in response to the control signal.

14. The ink jet head control circuit according to claim 13, wherein the control switch electrically disconnects the signal line from the ground potential when the non-volatile memory is being accessed.

15. The ink jet head control circuit according to claim 13, further comprising a power supply sequence control circuit connected to a power supply circuit and the drive control circuit.

16. The ink jet head control circuit according to claim 13, wherein the signal line is one of a plurality of signal lines connected between the drive control circuit and the ink jet head.

* * * * *